US009721736B2

(12) United States Patent
Mau et al.

(10) Patent No.: US 9,721,736 B2
(45) Date of Patent: Aug. 1, 2017

(54) BUTTON MODULE AND ELECTRONIC DEVICE HAVING THE SAME

(71) Applicants: LITE-ON ELECTRONICS (GUANGZHOU) LIMITED, Guangzhou (CN); LITE-ON TECHNOLOGY CORPORATION, Taipei (TW)

(72) Inventors: Shu-Hua Mau, Taoyuan County (TW); Pin-Ying Tseng, Tainan (TW)

(73) Assignees: LITE-ON ELECTRONICS (GUANGZHOU) LIMITED, Guangzhou (CN); LITE-ON TECHNOLOGY CORPORATION, Taipei (TW)

( * ) Notice: Subject to any disclaimer, the term of this patent is extended or adjusted under 35 U.S.C. 154(b) by 0 days.

(21) Appl. No.: 15/191,849

(22) Filed: Jun. 24, 2016

(65) Prior Publication Data

US 2017/0148588 A1 May 25, 2017

(30) Foreign Application Priority Data

Nov. 20, 2015 (CN) ..... 2015 2 0938486 U

(51) Int. Cl.
*H01H 13/14* (2006.01)

(52) U.S. Cl.
CPC ..... *H01H 13/14* (2013.01); *H01H 2221/044* (2013.01); *H01H 2235/00* (2013.01)

(58) Field of Classification Search
CPC ..... H01H 13/14; H01H 2221/044; H01H 2235/00; H01H 13/705; H01H 13/52; H01H 13/023; H01H 13/70
USPC .... 200/341, 345, 329, 314, 520, 536, 43.18, 200/16 R
See application file for complete search history.

(56) References Cited

U.S. PATENT DOCUMENTS 8,129,640 B2 * 3/2012 Liao ..... H01H 13/023 200/314
8,247,719 B2 * 8/2012 Lee ..... H01H 13/023 200/296
9,153,891 B2 * 10/2015 Fujita ..... H01R 13/04

* cited by examiner

*Primary Examiner* — Edwin A. Leon
(74) *Attorney, Agent, or Firm* — Li & Cai Intellectual Property (USA) Office

(57) ABSTRACT

An electronic device includes a housing, a button module and a control board. The button module includes a button cap having a space, a follower movably disposed in the space, and an elastic member. A movable cavity is defined by a portion of the follower located in the space and an inner surface of the button cap. The elastic member is disposed in the movable cavity, and two ends of the elastic member respectively abut against the inner surface of the button cap and the follower. An amount of compression of the elastic member is varied in response to the size of the movable cavity. When the button cap is in an unpressed state, the elastic member has a first amount of compression and generates a restoring force; when the button cap is in a pressed state, the follower abuts against a switch unit of the control board correspondingly.

19 Claims, 9 Drawing Sheets

D

BUTTON MODULE AND ELECTRONIC DEVICE HAVING THE SAME

TECHNICAL FIELD

The present invention relates to an electronic device having a button module, more particularly to the button module with a buffering and mitigating function for preventing a switch unit from being destroyed by an excessive force.

BACKGROUND ART

Today, in various common devices, a button structure is often used to trigger switches of a device to activate relevant functions of the device. The various switches have respective maximum bearable forces; that is, when a pressing force applied by a user is greater than the maximum bearable force of a switch, the switch may be destroyed. Accordingly, how to effectively prevent a switch from being destroyed due to an excessive force is an issue that manufacturers have to deal with. Therefore, after an extensive research in conjunction with theoretical knowledge, the inventors provide this invention that is reasonably designed and effectively solves the above problem.

SUMMARY OF THE INVENTION

The main objective of the present invention is to provide an electronic device having a button module to contact with a switch unit, in which when a user applies an excessive force on a button cap of the button module, a portion of the excessive force can be absorbed or dispersed, so that the switch unit does not be destroyed by the excessive force.

In some implementations, an electronic device comprises a housing, a button module and a control board. The button module is disposed in the housing and comprises a button cap, a follower, and an elastic member. The butter cap includes a pressing surface defined on an outer surface thereof and an accommodating space recessedly formed on an inner surface thereof opposite to the pressing surface. The follower is engaged with the button cap and a portion of the follower is movably arranged in the accommodating space of the button cap. A movable cavity is defined by the portion of the follower located in the accommodating space and the inner surface of the button cap. A size of the movable cavity is varied with a movement of the portion of the follower in the accommodating space. The elastic member is disposed in the movable cavity, and two ends of the elastic member abut against the inner surface of the button cap and the follower respectively. An amount of compression of the elastic member is varied in response to the size of the movable cavity. When the button cap is in an unpressed state, the elastic member has a first amount of compression and a restoring force is generated by the elastic member. The control board is disposed in the housing and includes a switch unit disposed correspondingly to a position of the follower; wherein when the button cap is in a pressed state, the follower abuts against and contacts the switch unit correspondingly.

Other implementation is directed to a button module used for an electronic device, the button module comprises a button cap, a follower, and an elastic member. The butter cap includes a pressing surface defined on an outer surface thereof and an accommodating space recessedly formed on an inner surface thereof opposite to the press surface. The follower is engaged with the button cap and a portion of the follower is movably arranged in the accommodating space of the button cap. A movable cavity is defined by the portion of the follower located in the accommodating space and the inner surface of the button cap. A size of the movable cavity is varied with a movement of the portion of the follower in the accommodating space. The elastic member is disposed in the movable cavity, and two ends of the elastic member abut against the inner surface of the button cap and the follower respectively. An amount of compression of the elastic member is varied in response to the size of the movable cavity. When the button cap is in an unpressed state, the elastic member has a first amount of compression and a restoring force is generated by the elastic member.

In order to further understand the features and technical content of the present invention, reference can be made to the detailed description and accompanying drawings of the present invention. However, the accompanying drawings are only provided for reference and illustration, but not intended to limit the present invention.

DETAILED DESCRIPTION OF THE PREFERRED EMBODIMENTS

Embodiments of a button module and an electronic device having the same thereof of the present invention are described below with specific examples. Other advantages and effects of the present invention can be readily understood by persons skilled in the art from the disclosure of this description. The present invention may also be implemented as or applied in other different specific examples. All details in this description may also be modified or changed based on different ideas and applications without departing from the spirit of the present invention. It is noted that the drawings of the present invention are only intended for illustration and are not drawn to scale, that is, actual dimensions of relevant components are not reflected. The following embodiments are used to further describe the concept of the present invention in detail, but are not intended to limit the scope of the present invention in any way.

Figure 1:
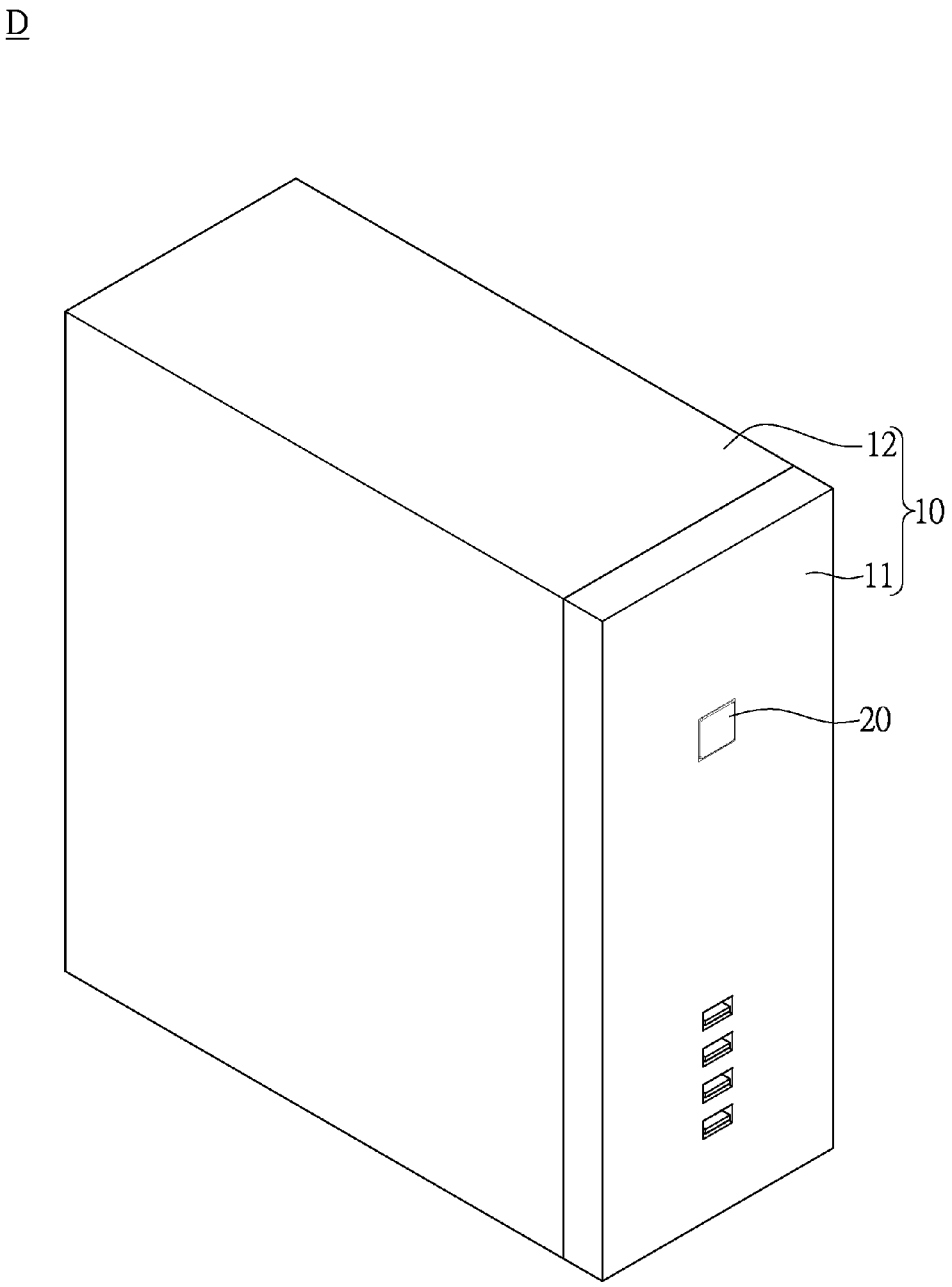
FIG. 1 is a schematic view of an electronic device having a button module according to the exemplary embodiment of the invention.
Figure 2:
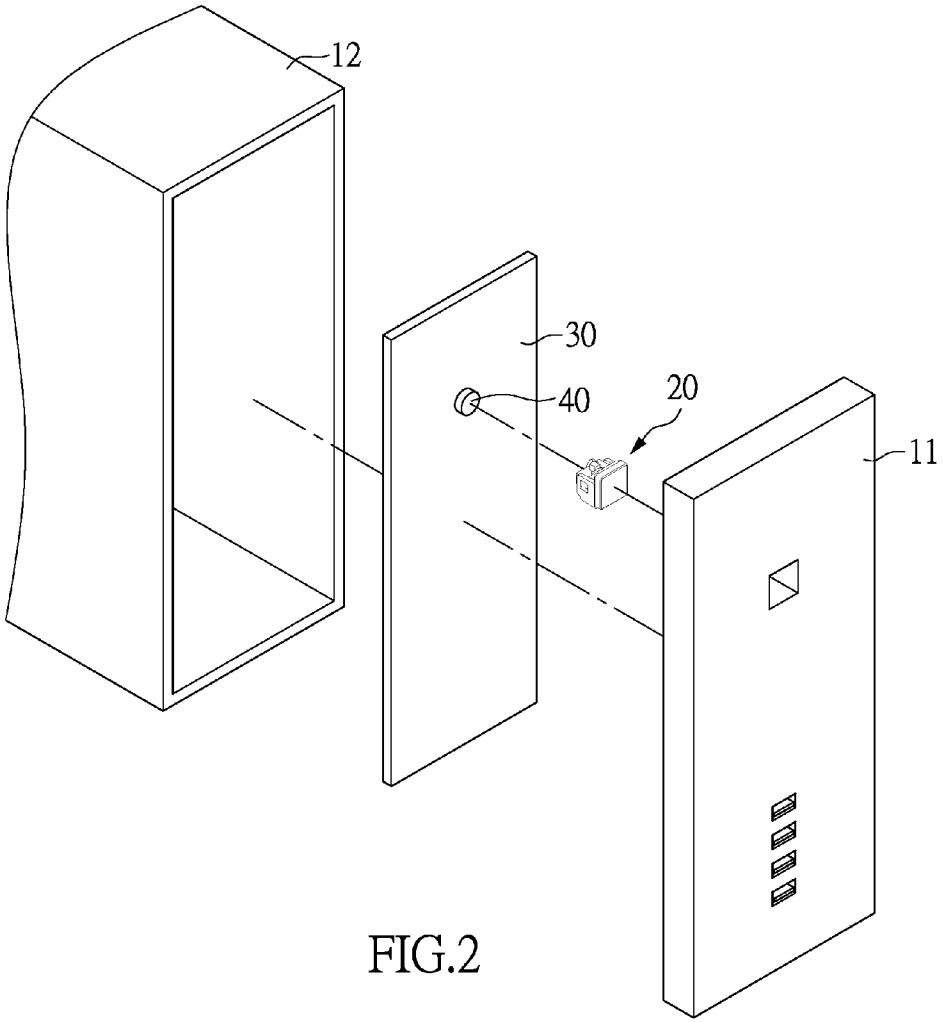
FIG. 2 is an exploded schematic view of the electronic device according to the exemplary embodiment of FIG. 1.

FIG. 1 and FIG. 2 are schematic assembled and exploded views of an electronic device D having a button module 20 of the present invention. As shown, the electronic device D includes a housing 10, a button module 20, a control board 30, and a switch unit 40. The housing 10 may include a front housing 11 and a rear housing 12. The button module 20 is disposed on the front housing 11. The control board 30 is disposed in the housing 10. The switch unit 40 is disposed on the control board 30. The electronic device D may be any type of electronic device, such as a computer, a server, appliances, and so on. The button module 20 may be any push-type button. In addition, in this embodiment, the control board 30 may be a circuit board, and the switch unit 40 is disposed on the circuit board 30 in the housing 10 of the computer, but the present invention is not limited thereto. In other embodiments, the control board 30 can be disposed on the front housing 11 together with the button module 20 (naturally with a gap between the control board 30 and the button module 20).

Figure 3:
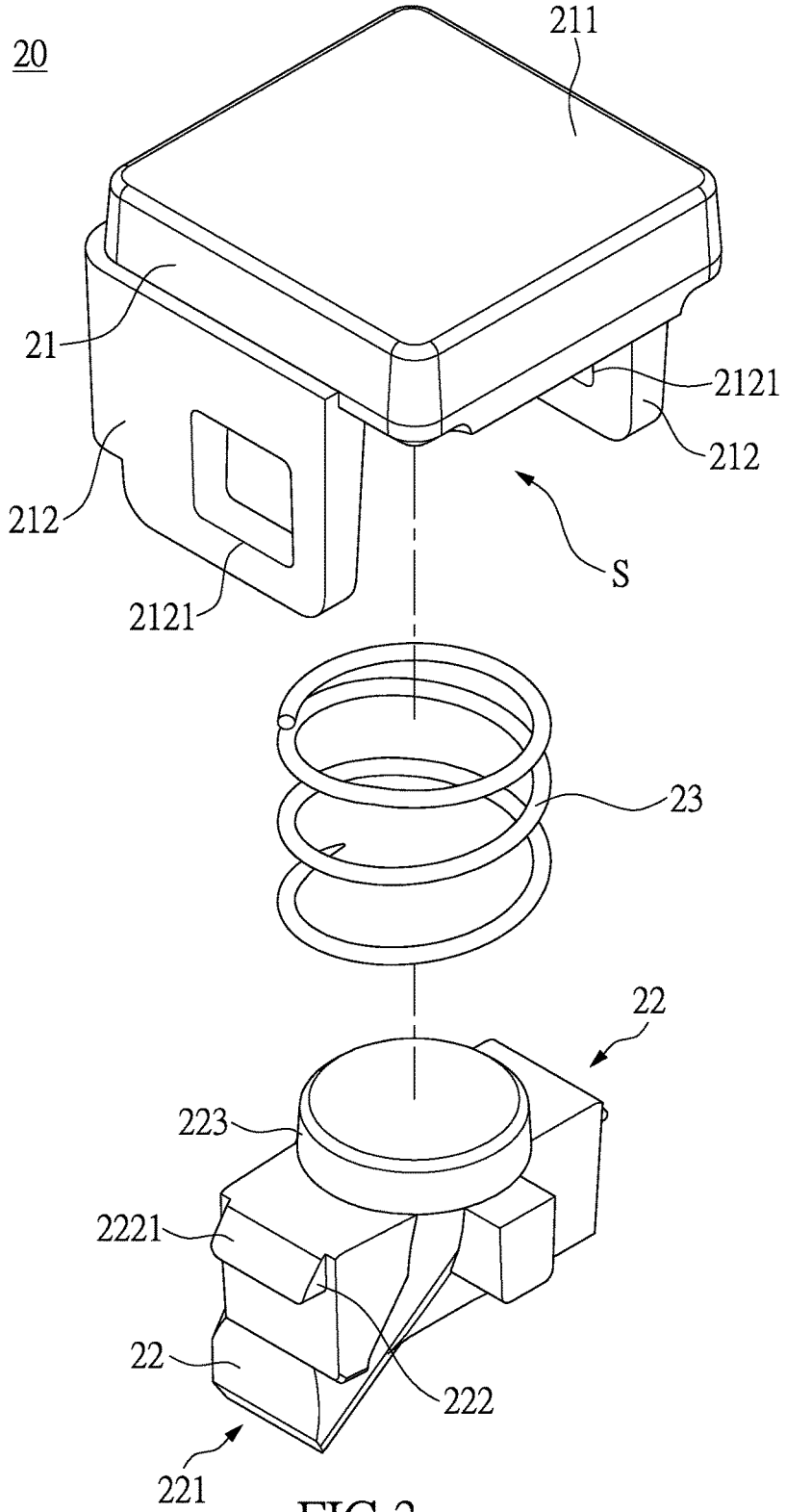
FIG. 3 is an exploded schematic view of the button module according to the exemplary embodiment of the invention.
Figure 4:
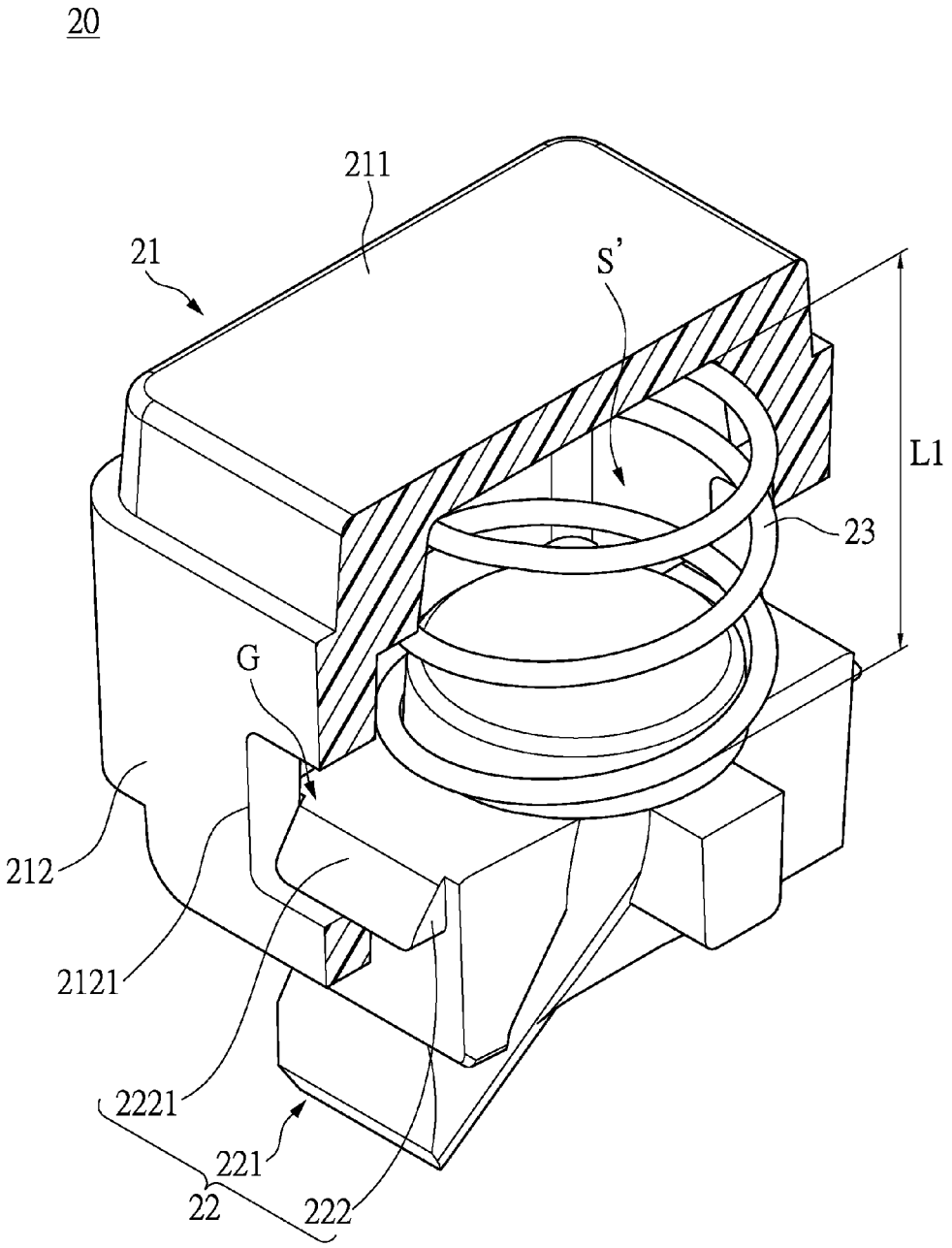
FIG. 4 is a schematic assembled view illustrating the button module of FIG. 3.

FIG. 3 and FIG. 4 are schematic exploded and assembled views of the button module 20 of the present invention. As shown, the button module 20 includes a button cap 21, a follower 22 and an elastic member 23. The follower 22 is disposed at a lower end (opposite to a pressing surface 211 of an upper end) of the button cap 21 to be movable relative to the button cap 21. The elastic member 23 is positioned between the button cap 21 and the follower 22. Also, the button cap 21 is movable relative to the follower 22, and then the elastic member 23 is forcedly compressed.

Specifically, referring to FIG. 3, the button cap 21 includes a pressing surface 211 defined on an outer surface thereof. The button cap 21 has an accommodating space S recessedly formed on an inner surface thereof opposite to the pressing surface 211. The accommodating space S is defined by an inner wall and two opposite side walls 212 of the inner surface of the button cap 21. The side walls 212 are approximately perpendicular to the pressing surface 211. A guiding groove 2121 is formed at each of the two side walls 212 respectively. In the figures of the present embodiment, each guiding groove 2121 passes, for example, through the corresponding side wall 212, but in other applications, the present invention is not limited thereto. Each guiding groove 2121 in various embodiments may also not pass through the corresponding side wall 212. In addition, in the figures, the two guiding grooves 2121 are, for example, disposed at the two side walls 212 opposite to each other, but in other applications, the two guiding grooves 2121 may also be disposed at two adjacent side walls 212. However, the number and position of the side walls 212 and the guiding grooves 2121 are not limited to the examples provided herein, and can be changed according to the practical requirements.

Figure 6:
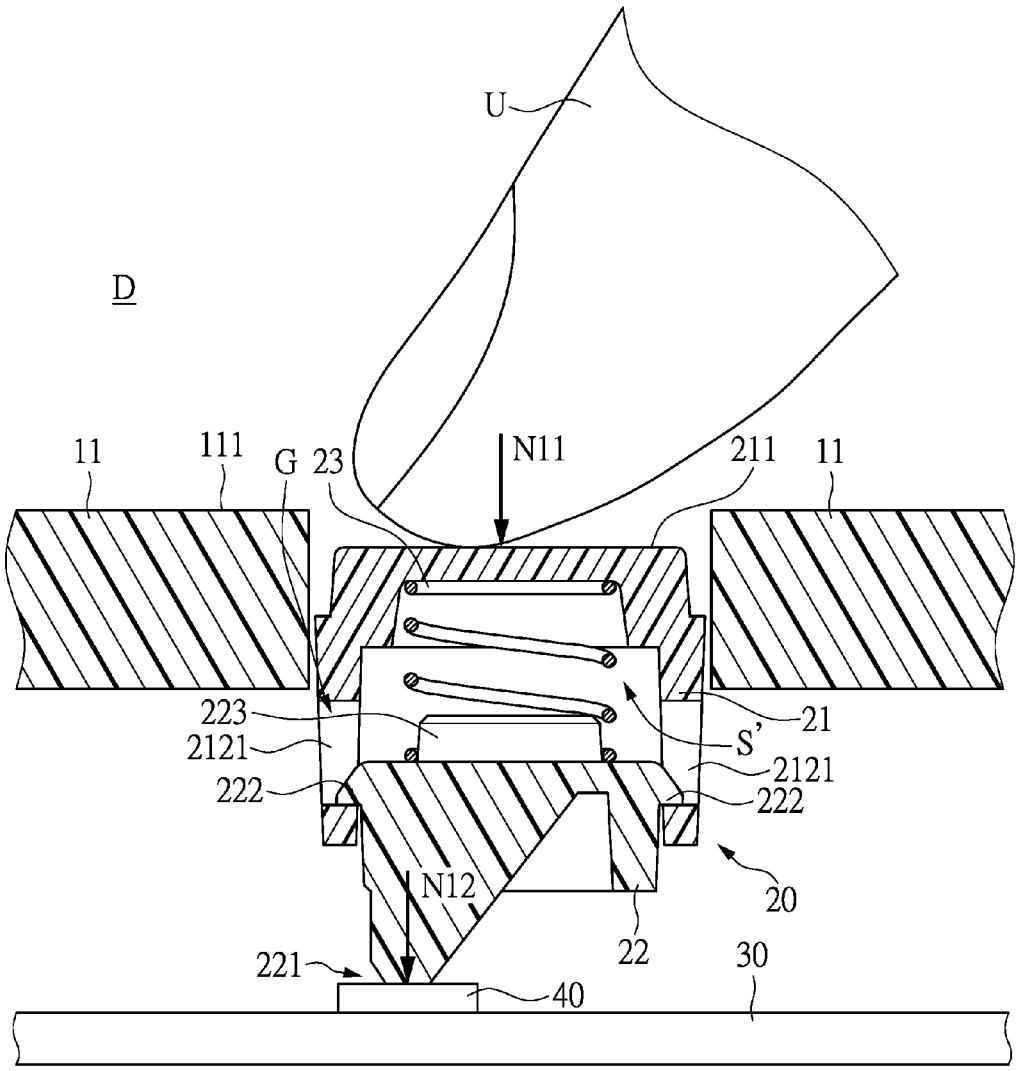
FIG. 6 is a schematic, cross-sectional side view showing a first operation of the electronic device having the button module according to the exemplary embodiment of FIG. 5.

The follower 22 includes a pressing portion 221 protruded on an end thereof in the direction far away from the pressing surface 211. The pressing portion 221 can selectively abut against and contact the switch unit 40 formed on the control board 30. A guiding member 222 is formed on each of two side walls of the follower 22 opposite to each other. The two guiding members 222 are configured to engage with the two guiding grooves 2121 of the button cap 21, so that the follower 22 and the button cap 21 can be moved relative to each other. When the button module 20 is pressed, the pressing portion 221 correspondingly abuts against the switch unit 40 (as shown in FIG. 6).

The follower 22 includes a positioning portion 223 formed at an end thereof opposite to the pressing portion 221. The positioning portion 223 is configured to assist in positioning the elastic member 23. Specifically, the positioning portion 223 may be a cylinder structure. The elastic member 23 may be a compression spring. An outer diameter of the positioning portion 223 may be not less than (slightly greater than) an inner diameter of the elastic member 23, so that one end of the elastic member 23 can be tightly fitted on the positioning portion 223. In other applications, the inner surface of the button cap 21 may also have a corresponding positioning portion (not shown) to position the other end of the elastic member 23. In this embodiment, the elastic member 23 is, for example, a compression spring, but the present invention is not limited thereto. The elastic member 23 can be a relevant extensible and compressible structure such as an elastic sheet.

As shown in FIG. 4, the two guiding members 222 of the follower 22 can correspondingly engage in the two guiding grooves 2121 of the button cap 21. A movable cavity S' is defined by a portion of the follower 22 located in the accommodating space S (see FIG. 3 again) and the inner surface of the button cap 21. The elastic member 23 is correspondingly disposed in the movable cavity S' and is arranged between the button cap 21 and the follower 22. The elastic member 23 disposed in the movable cavity S' has one end abutting against the inner wall of the button cap 21, and the other end abutting against the follower 22 and correspondingly sleeved on the positioning portion 223. In a preferred embodiment, each of the guiding members 222 includes an inclined surface 2221 formed thereon for quickly engaging in the corresponding guiding groove 2121 when the follower 22 is assembled to the button cap 21.

It should be particularly noted that, in FIG. 4, a distance between the portion of the follower 22 located in the accommodating space S (i.e., the end of the follower 22 formed with the positioning portion 223, see FIG. 3 again) and the inner surface of the button cap 21 (the inner surface close to the pressing surface 211), i.e., a longitudinal length of the movable cavity S', is less than the longitudinal length of the uncompressed elastic member 23, so that the elastic member 23 disposed in the movable cavity S' is pressed by the assembly of the button cap 21 and the follower 22 to be in a compressed state. In other words, the elastic member 23 in FIG. 4 is in the compressed state and has a first amount of compression, each guiding member 222 correspondingly abuts against one side of the corresponding guiding groove 2121 distal from the pressing surface 211 under the action of a restoring force of the elastic member 23, so that the button cap 21, the elastic member 23 and the follower 22 can be securely connected to one another. In this case, the pressing portion 221 is correspondingly exposed at the side of the button cap 21 formed with the accommodating space S.

Moreover, when each of the two guiding members 222 correspondingly abuts against the side (the side distal from the pressing surface 211) of the corresponding guiding groove 2121 under the restoring force of the elastic member 23, a moving gap G exists between a side of each guiding member 222 that is opposite to another side thereof abutting against the side of the guiding groove 2121 and another side of the guiding groove 2121. Therefore, the portion of the follower 22 located in the accommodating space S (see FIG. 3 again) is correspondingly movable in the accommodating space S, thereby correspondingly varying the size of the movable cavity S' and in turn the amount of compression of the elastic member 23 disposed in the movable cavity S'. In other words, through the engagement relationship of the two guiding members 222 and the two guiding grooves 2121, the follower 22 and the button cap 21 are movable relative to each other, to vary the size of the movable cavity S' and the amount of compression of the elastic member 23 accordingly.

Figure 5:
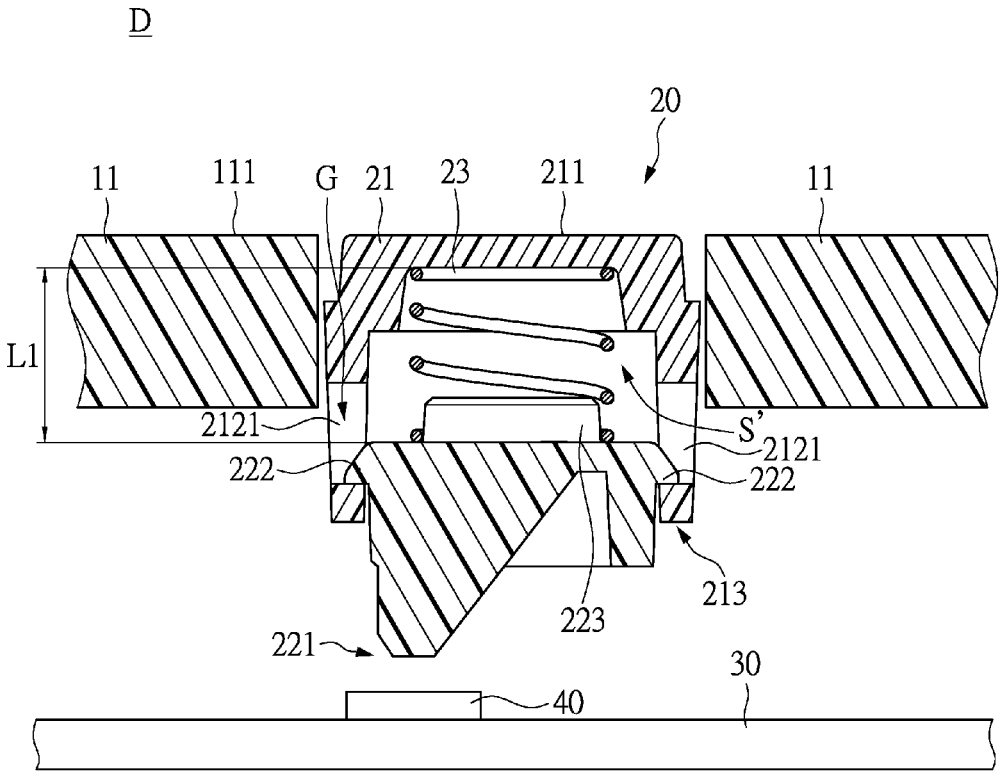
FIG. 5 is a schematic, cross-sectional side view of illustration of the electronic device having the button module according to the exemplary embodiment of the invention.

FIG. 5 is a schematic cross-sectional view showing the button module 20 being installed in the front housing 11. As shown in FIG. 5, the button cap 21 is in an "unpressed" state, when no press force is applied to the pressing surface 211 and the button cap 21 is in the unpressed position (i.e., "ready" position). In the unpressed state, the pressing surface 211 of the button cap 21 may be approximately level with an outer surface 111 of the front housing 11 (naturally, in other embodiments, the pressing surface 211 can be slightly lower or higher than the outer surface 111). The follower 22 is under the action of the restoring force of the elastic member 23, and each guiding member 222 abuts against the side of the corresponding guiding groove 2121 distal from the pressing surface 211.

It is noted that, in the figures of the present embodiment, a restoring unit (not shown) provides a restoring force for returning the button cap 21 to its original state (an unpressed state) when the button cap 21 is released. The restoring unit may be configured to be connected to the button cap 21 and the front housing 11, to assist in restoring the button cap 21 to the unpressed state after being pressed. For example, the restoring unit may be an elastic sheet or an elastic arm having one end fixed to the button cap 21 and the other end fixed to the inner wall of the housing 10 (which may be a separate component or be integrally formed with and extending outwardly from the button cap 21). Alternatively, the restoring unit may be a compression spring, correspondingly sleeved on the button cap 21 or disposed between the button cap 21 and the housing 10.

Referring to FIG. 5 and FIG. 6, FIG. 6 is a schematic cross-sectional side view showing a first operation of the electronic device D having the button module 20 according to the exemplary embodiment of FIG. 5. It is a view illustrating a state in which a user U applied a normal force to press the button module 20 (i.e., in a normal use state); that is, a first external force N11 applied by the user U to the pressing surface 211 of the button cap 21 is not greater than a maximum bearable force of the switch unit 40. It should be noted that, when the elastic member 23 is assembled between the button cap 21 and the follower 22, the restoring force generated by the elastic member 23 is less than (or not greater than) the maximum bearable force of the switch unit 40; that is, the first external force N11 is not greater than the restoring force of the elastic member 23.

Referring to FIG. 5 again, when the user U applies the first external force N11 in FIG. 6 to the pressing surface 211 of the button cap 21, the button cap 21, the follower 22, and the elastic member 23 of the button module 20 engaged in a substantially rigid state through the restoring force of the elastic member 23 can move together toward the switch unit 40. As shown in FIG. 6, when the pressing portion 221 of the follower 22 is abutted against and contact the switch unit 40, the pressing portion 221 of the follower 22 correspondingly applies a first pressing force N12 to the switch unit 40. Because the first external force N11 is not greater than the maximum bearable force of the switch unit 40 and less than the restoring force of the elastic member 23, when the first external force N11 is transferred to the switch unit 40 through the button cap 21, the follower 22, and the elastic member 23 (the three are engaged in a substantially rigid state), the resulting first pressing force N12 is approximately equal to the first external force N11 and is not greater than the maximum bearable force of the switch unit 40. In other words, when the user U applies a force not greater than the maximum bearable force (which is substantially equal to a restoring force generated by the elastic member 23 installed in the movable cavity S') of the switch unit 40 to the pressing surface 211, the elastic member 23 is not further compressed, and thus keeping an amount of compression initially generated (i.e., the first amount of compression) when installed in the movable cavity S'.

More specifically, in a state of static balance in FIG. 6, the first external force N11 is approximately equal to the first pressing force N12, the restoring force of the elastic member 23 borne by the button cap 21 is approximately equal to the first external force N11, and the reaction force transferred by the switch unit 40 to the elastic member 23 through the follower 22 is also approximately equal to the restoring force of the elastic member 23; that is, the first external force N11 and the reaction force from the switch unit 40 borne by the elastic member 23 are approximately equal to the restoring force of the elastic member 23 itself, so that the elastic member 23 is in a state of static balance and has an unchanged amount of compression.

When the user U in FIG. 6 stops pressing the button cap 21, the button module 20 is restored to the unpressed state shown in FIG. 5 through the restoring unit described above (not shown). In the restoring process, the button cap 21, the elastic member 23, and the follower 22 are also similar to a rigid unit and moved together in a direction away from the switch unit 40. Namely, in this embodiment, the elastic member 23 is not a component for restoring the button cap 21 to the unpressed state after being pressed.

Figure 7:
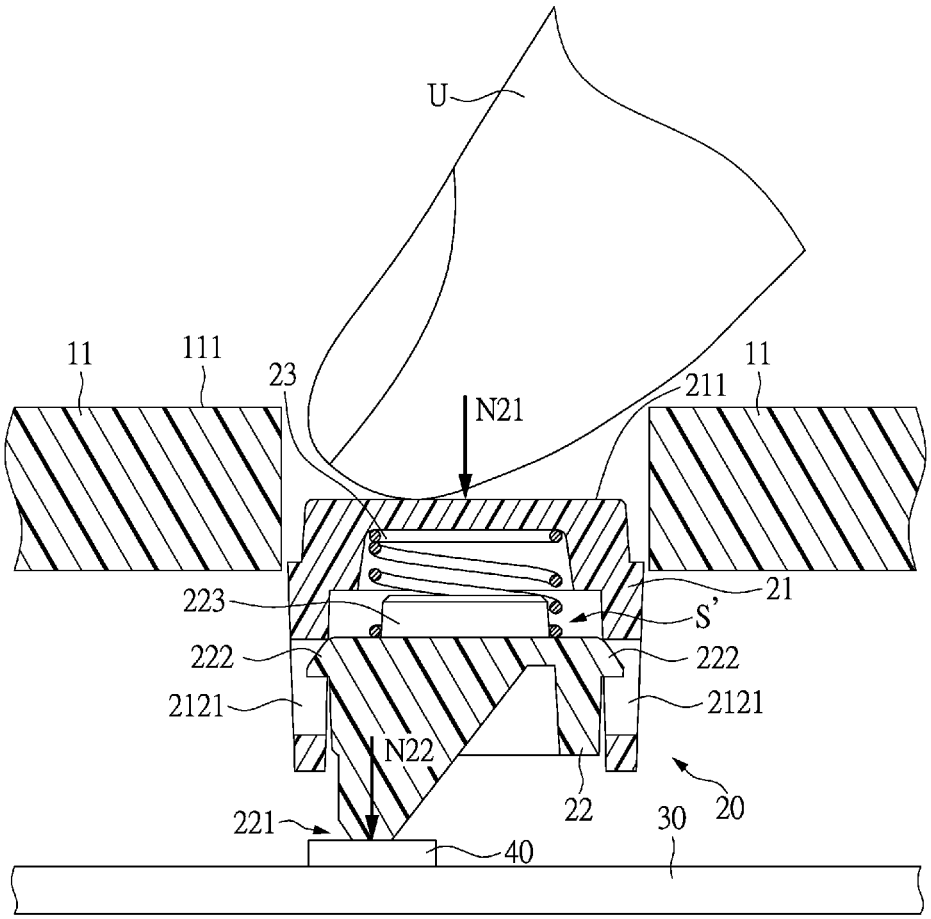
FIG. 7 and FIG. 8 are cross-sectional, schematic views showing a second operation of the electronic device having the button module according to the exemplary embodiment of FIG. 5.
Figure 8:
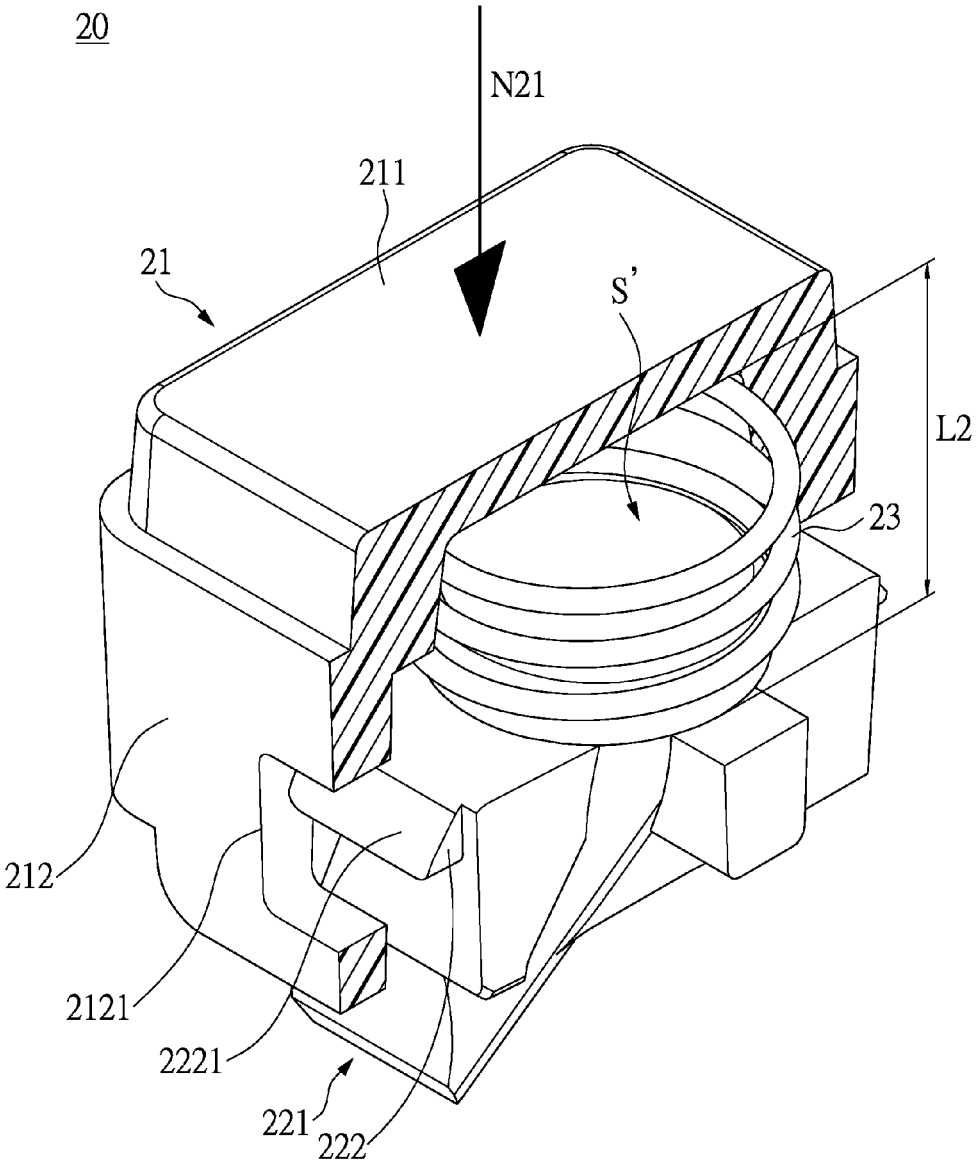

Referring to FIG. 7 and FIG. 8, FIG. 7 is a schematic cross-sectional side view showing a second operation of the electronic device D having the button module 20 according to the exemplary embodiment of FIG. 5. It is a view illustrating a state in which the user U applied an abnormal force to press the button module 20; that is, a second external force N21 applied by the user U to the pressing surface 211 of the button cap 21 is greater than the maximum bearable force of the switch unit 40. FIG. 8 is a schematic perspective view when the button module 20 is pressed. In this state, the second external force N21 is greater than the first external force N11 shown in FIG. 6. However, through the relative movement among the button cap 21, the follower 22, and the elastic member 23, a second external force N22 shown in FIG. 7 is not greater than the maximum bearable force of the switch unit 40; that is, when the user U applies the second external force N21 that might destroy the switch unit 40 to the pressing surface 211 of the button cap 21 and then the pressing portion 221 of the follower 22 contacts with the switch unit 40, the button module 20 of the present invention can absorb (disperse) a portion of the second external force N21 through the relative movement of the button cap 21, the follower 22, and the elastic member 23, so that the second pressing force N22 applied by the follower 22 to the switch unit 40 is less than the maximum bearable force of the switch unit 40, so as to effectively protect the switch unit 40 from being destroyed by the follower 22 due to pressing with an excessive force by the user U.

Specifically, When the first external force N11 in FIG. 6 is changed to the second external force N21 in FIG. 7, because the second external force N21 is greater than the restoring force of the elastic member 23, the button cap 21 presses against the elastic member 23 under the action of the second external force N21, so that the elastic member 23 is compressed further toward the switch unit 40. Therefore, a portion of the second external force N21 is absorbed by the further compressed elastic member 23, so that the second pressing force N22 still remains not greater than the maximum bearable force of the switch unit 40.

In short, when the user U applies a force greater than the maximum bearable force of the switch unit 40 to the pressing surface 211 of the button cap 21 and the pressing portion 221 correspondingly abuts against and contacts the switch unit 40, the elastic member 23 is further compressed (the amount of compression is changed from the first amount of compression to a relatively larger second amount of compression) to absorb a portion of the force applied to the pressing surface 211, so that the force acting on the switch unit 40 is less than the maximum bearable force of the switch unit 40, thereby achieving the effect of protecting the switch unit 40.

More specifically, the button module 20 of the present invention can provide the user U with the effect similar to a two-stage operation. When the user U applies an external force not greater than the maximum bearable force of the switch unit 40 to the pressing surface 211, the button module 20 (in which the button cap 21, the follower 22, and the elastic member 23 are engaged in a substantially rigid state) moves toward the switch unit 40 until the pressing portion 221 of the follower 22 correspondingly abuts against the switch unit 40 to activate the electronic device D; when the user U applies an external force, which is greater than the maximum bearable force of the switch unit 40, to the pressing surface 211, the pressing portion 221 of the follower 22 correspondingly abuts against the switch unit 40, and the button cap 21 keeps moving further toward the switch unit 40 to correspondingly compress the elastic member 23, so that a portion of the external force is absorbed through the compression of the elastic member 23, thereby preventing the switch unit 40 from being destroyed by an excessive force.

For the elastic member 23, the longitudinal length L2 of the elastic member 23 shown in FIG. 8 is shorter than the longitudinal length L1 of the elastic member 23 shown in FIG. 4 (and FIG. 5), and the second amount of compression of the elastic member 23 in FIG. 8 is greater than the first amount of compression of the elastic member 23 in FIG. 4 (and FIG. 5). In other applications, the number of the elastic member 23 may be two or more to assist in absorbing a larger portion of the second external force N21.

It should be particularly noted that, referring to FIG. 6 and FIG. 7 together, it can be seen that the moving gap G is defined by each guiding member 222 movable relative to the guiding groove 2121. Moreover, when the user U applies a force (i.e., the second external force N21) greater than the maximum bearable force of the switch unit 40, the elastic member 23 may be further compressed to possibly absorb the force due to the moving gap G (shown in FIG. 7).

Figure 9:
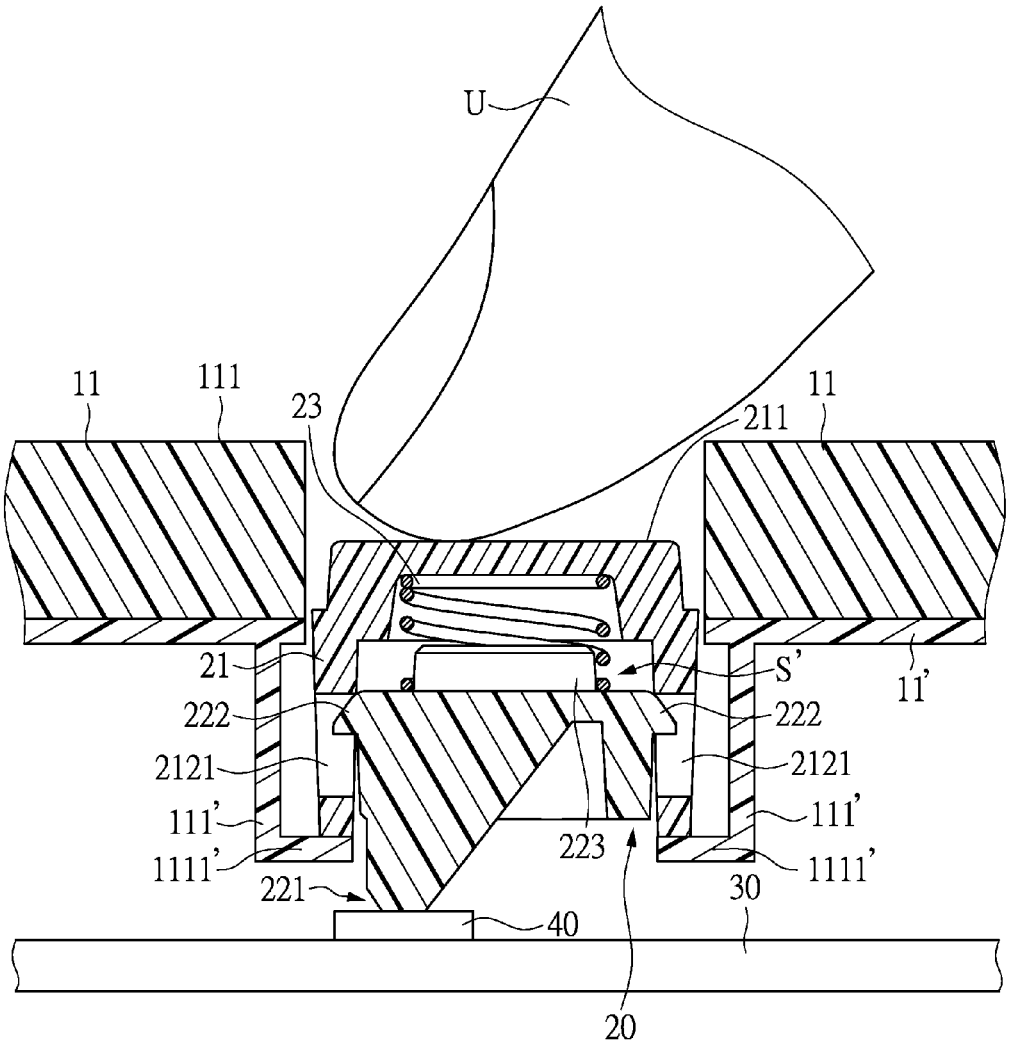
FIG. 9 is a schematic, cross-sectional side view of the electronic device having the button module according to another exemplary embodiment of the invention.

FIG. 9 shows another embodiment of the electronic device D of the present invention. As shown, the front housing 11 further includes a stopping structure 11' on its side facing the control board 30. In this embodiment, the stopping structure 11' includes two stopping arms 111' each extended in a direction away from the outer surface 111 of the front housing 11, and two stopping portions 1111' each extended inwardly from a free end of each of the stopping arms 111'. Each of the stopping portions 1111' is correspondingly located under a lower edge 213 (as shown in FIG. 5) of the button cap 21. Therefore, when the user U applies a force greater than the maximum bearable force of the switch unit 40 to the button cap 21, the stopping structure 11' can correspondingly be abutted against the lower edge 213 of the button cap 21 to limit a movement of the button cap 21. In this way, a portion of the force applied to the pressing surface 211 can be dispersed (absorbed) through the stopping structure 11', and the stopping structure 11' can further be used to more effectively avoid the problem that the follower 22 may directly destroy the switch unit 40 when the larger force applied by the user U to the pressing surface 211 causes the elastic member 23 to be compressed to a maximally compressed state (in which the elastic member 23 cannot be further compressed). Specifically, in other applications, the size and allowed amount of compression of the elastic member 23 are indirectly limited by the size of the button cap 21, and thus the force that can be absorbed by the elastic member 23 is limited to a certain extent. The provision of the stopping arms 111' and the stopping portions 1111' of the stopping structure 11' can assist in dispersing a portion of the force acting on the pressing surface 211 of the button cap 21.

According to the present invention, there are extremely advantageous effects that since the button module (including a button cap, a follower and an elastic member) is used, when an external force applied on the button cap by a user is greater than a maximum bearable force of the switch unit, a part of the external force applied on the button cap can be effectively absorbed, so as to prevent the switch unit from being destroyed by the excessive force.

The description above is only preferred embodiments of the present invention and is not intended to limit the scope of the present invention. All equivalents with technical changes made according to the specification and drawings of the present invention fall within the scope of the present invention.

What is claimed is:

1. An electronic device comprising:

a housing;

a button module disposed in the housing, wherein the button module comprises:

a button cap including a pressing surface defined on an outer surface thereof and an accommodating space recessedly formed on an inner surface thereof opposite to the pressing surface;

a follower engaged with the button cap and having a portion movably arranged in the accommodating space of the button cap, a movable cavity defined by the portion of the follower located in the accommodating space and the inner surface of the button cap, wherein a size of the movable cavity is varied with a movement of the portion of the follower in the accommodating space; and an elastic member disposed in the movable cavity, two ends of the elastic member respectively abutting against the inner surface of the button cap and the follower, wherein an amount of compression of the elastic member is varied in response to the size of the movable cavity, and when the button cap is in an unpressed state, the elastic member has a first amount of compression and the elastic member generates a restoring force; and a control board disposed in the housing and including a switch unit disposed correspondingly to a position of the follower; wherein when the button cap is in a pressed state, the follower abuts against and contacts the switch unit correspondingly.

2. The electronic device of claim 1, wherein when the button cap is in the unpressed state, the restoring force generated by the elastic member abutting against the button cap and the follower is not greater than a maximum bearable force of the switch unit.

3. The electronic device of claim 2, wherein the inner surface of the button cap further comprises an inner wall and two opposite side walls substantially perpendicular to the pressing surface, and the accommodating space is defined by the inner wall and the two opposite side walls of the inner surface of the button cap, each of two opposite side walls of the button cap is formed with a guiding groove, and the follower includes two guiding members corresponding to and engaged in the guiding grooves; the guiding members are movable in the guiding grooves correspondingly, so that the follower and the button cap are movable relative to each other; when the button cap is in the unpressed state, each of the guiding members abuts against one side of the guiding groove distal from the pressing surface under the restoring force of the elastic member; and a moving gap exists between each of the guiding members and the other side of the guiding groove.

4. The electronic device of claim 3, wherein the guiding members each includes an inclined surface formed thereon.

5. The electronic device of claim 3, wherein the housing further comprises a stopping structure, and when the button cap is subjected to an external force greater than the maximum bearable force of the switch unit, the stopping structure abuts against a lower edge of the button cap to limit a movement of the button cap.

6. The electronic device of claim 2, wherein when the pressing surface of the button cap is subjected to an external force not greater than the maximum bearable force of the switch unit in the pressed state, the first amount of compression of the elastic member is not changed.

7. The electronic device of claim 3, wherein when the pressing surface of the button cap is subjected to an external force not greater than the maximum bearable force of the switch unit in the pressed state, the first amount of compression of the elastic member is not changed.

8. The electronic device of claim 2, wherein when the pressing surface of the button cap is subjected to an external force greater than the maximum bearable force of the switch unit in the pressed state, the elastic member is compressed to have a second amount of compression, wherein the second amount of compression is greater than the first amount of compression.

9. The electronic device of claim 3, wherein when the pressing surface of the button cap is subjected to an external force greater than the maximum bearable force of the switch unit in the pressed state, the elastic member is compressed to have a second amount of compression, wherein the second amount of compression is greater than the first amount of compression.

10. The electronic device of claim 1, wherein, the follower includes a pressing portion protruded on an end thereof in a direction far away from the pressing surface.

11. A button module, used for an electronic device, the button module comprising:

a button cap including a pressing surface defined on an outer surface thereof and an accommodating space recessedly formed on an inner surface thereof opposite to the pressing surface;

a follower engaged with the button cap and having a portion movably arranged in the accommodating space of the button cap, a movable cavity defined by the portion of the follower located in the accommodating space and the inner surface of the button cap, wherein a size of the movable cavity is varied with a movement of the portion of the follower in the accommodating space; and an elastic member disposed in the movable cavity, two ends of the elastic member respectively abutting against the inner surface of the button cap and the follower, wherein an amount of compression of the elastic member is varied in response to the size of the movable cavity, and when the button cap is in an unpressed state, the elastic member has a first amount of compression and the elastic member generates a restoring force.

12. The button module of claim 11, wherein the inner surface of the button cap further comprises an inner wall and two opposite side walls substantially perpendicular to the pressing surface, and the accommodating space is defined by the inner wall and the two opposite side walls of the inner surface of the button cap, each of two opposite side walls of the button cap is formed with a guiding groove, and the follower includes two guiding members corresponding to and engaged in the guiding grooves; the guiding members are movable in the guiding grooves correspondingly, so that the follower and the button cap are movable relative to each other; when the button cap is in the unpressed state, each of the guiding members abuts against one side of the corresponding guiding groove distal from the pressing surface under the restoring force of the elastic member; and a moving gap exists between each of the guiding members and the other side of the guiding groove.

13. The button module of claim 11, wherein, the follower includes a pressing portion protruded on an end thereof in a direction far away from the pressing surface.

14. The button module of claim 13, wherein the follower includes a positioning portion formed on an end thereof opposite to the pressing portion, for positioning the elastic member and the follower to each other.

15. The button module of claim 14, wherein the elastic member is a compression spring.

16. The button module of claim 15, wherein the positioning portion is a cylinder structure, and a diameter of the cylinder structure is not less than an inner diameter of the elastic member.

17. The button module of claim 12, wherein each of the guiding members includes an inclined surface.

18. The button module of claim 11, wherein when the button cap is in the unpressed state, the restoring force generated by the elastic member abutting against the button cap and the follower is not greater than a maximum bearable force of a switch unit of the electronic device.

19. The button module of claim 18, wherein the inner surface of the button cap further comprises an inner wall and two opposite side walls substantially perpendicular to the pressing surface, and the accommodating space is defined by the inner wall and the two opposite side walls of the inner surface of the button cap, each of the two opposite side walls of the button cap is formed with a guiding groove, and the follower includes two guiding members corresponding to and engaged in the guiding grooves; the guiding members are movable in the guiding grooves correspondingly, so that the follower and the button cap are movable relative to each other; when the button cap is in the unpressed state, each of the guiding members abuts against one side of the guiding groove distal from the pressing surface under the restoring force of the elastic member; and a moving gap exists between each of the guiding members and the other side of the guiding groove.

* * * * *